United States Patent [19]

Knotik et al.

[11] 4,139,488

[45] Feb. 13, 1979

[54] METHOD OF PREPARING SOLID RADIOACTIVE OR TOXIC WASTE FOR LONG-TERM STORAGE

[75] Inventors: Karl Knotik, Eisenstadt; Peter Leichter, Vienna; Heinz Jakusch, Ternitz, all of Austria

[73] Assignee: Vereinigte Edelstahlwerke Aktiengesellschaft, Vienna, Austria

[21] Appl. No.: 698,750

[22] Filed: Jun. 22, 1976

[30] Foreign Application Priority Data

Jun. 26, 1975 [AT] Austria ..... 4942/75

[51] Int. Cl.[2] ..... G21F 9/34

[52] U.S. Cl. ..... 252/301.1 W; 106/97; 106/281 R

[58] Field of Search ..... 252/301.1 W; 106/97, 106/281 R

[56] References Cited

U.S. PATENT DOCUMENTS

| | | | |
|---|---|---|---|
| 3,142,648 | 7/1964 | Lefillatre et al. | 252/301.1 W |
| 3,298,961 | 1/1967 | Davis et al. | 252/301.1 W |
| 3,334,050 | 8/1967 | Grotenhuis et al. | 252/301.1 R |
| 3,365,578 | 1/1968 | Grover et al. | 252/301.1 W |
| 3,463,738 | 8/1969 | Fitzgerald et al. | 252/301.1 W |
| 3,828,197 | 8/1974 | Boldt | 252/301.1 W |
| 3,883,441 | 5/1975 | Murphy et al. | 252/301.1 W |
| 3,935,467 | 1/1976 | Gabin | 252/301.1 W |
| 3,988,258 | 10/1976 | Curtiss et al. | 252/301.1 W |

FOREIGN PATENT DOCUMENTS

| | | | |
|---|---|---|---|
| 1614130 | 8/1970 | Fed. Rep. of Germany | 252/301.1 W |
| 1520681 | 4/1968 | France | 252/301.10 |
| 968763 | 9/1964 | United Kingdom | 252/301.1 W |

OTHER PUBLICATIONS

Perry, J. H. Ed. Chemical Engineers' Handbook (McGraw-Hill Book Co., Inc, New York), 1950, p. 853.

*Primary Examiner*—Benjamin R. Padgett
*Assistant Examiner*—Deborah L. Kyle

[57] ABSTRACT

Solid radioactive or toxic wastes are prepared for long-term storage by adding a hardenable binding agent to a container filled with the waste under a partial vacuum. The improved homogeneity of mixing of the binder and waste is enhanced by removing the partial vacuum prior to the hardening of the binder. The temperature of the container is maintained, during the addition of the binder agent to the waste, at a temperature at least equal to the melting temperature of the binder to assure thorough impregnation of the waste thereby. Preferably, the container supporting the resultant waste-binder matrix is placed in a larger container, and the space between the two containers is filled with bituminous material or concrete to provide added security against water penetration during storage.

10 Claims, 1 Drawing Figure

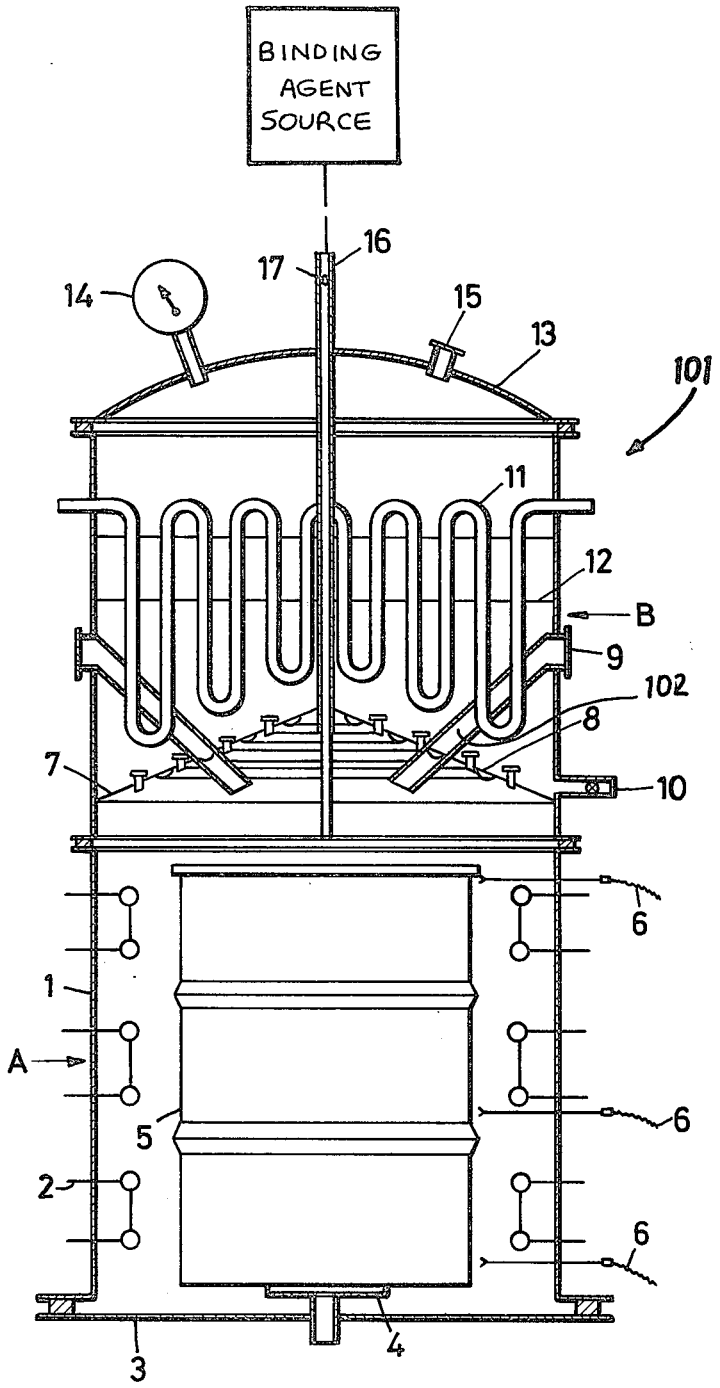
BINDING AGENT SOURCE
16
17
14
15
13
101
11
12
B
9
102
8
7
10
6
1
A
5
6
2
6
3
4

METHOD OF PREPARING SOLID RADIOACTIVE OR TOXIC WASTE FOR LONG-TERM STORAGE

BACKGROUND OF THE INVENTION

The invention relates to a method of preparing solid radioactive or toxic waste for long-term storage, and more particularly to a method of combining such waste with a hardenable binding agent.

In known processes for preparing mixtures of a radioactive or toxic waste and a hardenable binding agent to prevent escape of the active pollutants in the waste during the long-term storage thereof, the waste is contacted, under atmospheric pressure, with the binding agent while the latter is in a softened condition, after which the agent is permitted to harden to produce a solid waste-binder complex. Under such circumstances, the impregnation of the waste by the binding agent is not complete, and the matrix exhibits a porous structure which, when exposed to water penetration or the like during storage, has been susceptible to leaching and consequent atmospheric exposure of the active pollutant.

Moreover, in cases where the waste has a fine particulate structure, the particles thereof which are not impregnated by the binding agent can easily escape from the container that supports the waste and binder during the mixing operation.

SUMMARY OF THE INVENTION

These disadvantages are overcome with the waste-binder mixing technique of the present invention, wherein a highly homogeneous mixture of the binder with the waste is accomplished to assure uniform impregnation of the latter. Illustratively, the hardenable binding agent is added to a container filled with the waste while a partial vacuum is applied thereto. Such partial vacuum has been found to be especially effective in aiding the mixing and wetting of the waste by the softened binding agent, and thereby avoiding the presence of porous areas in the resulting matrix.

Preferably, the container is maintained at a temperature above the softening point of the binding agent during the addition of the agent to the waste. If it is desirable to dry the waste prior to the application of the binding agent, this can be accomplished by the simultaneous application of heat and a partial vacuum to the waste container before the agent is added.

For certain types of wastes, i.e., spent ion exchange resins which have embedded therein radioactive inorganic compounds through prior exposure of the resin to wastes from a nuclear processing installation or the like, it may be further preferable, prior to the addition of the binder to the waste, to thermally decompose the resin via carbonization in the presence of a medium that does not support combustion. A technique for accomplishing this is described in the copending, coassigned application Ser. No. 698,714, filed on even date herewith and entitled "TECHNIQUE FOR CONVERTING SPENT RADIOACTIVE ION EXCHANGE RESINS INTO A STABLE AND SAFELY STORABLE FORM".

Further enhancement of the homogeneity of the waste-binder matrix may be assured by removing the partial vacuum after the addition of the binder to the waste and before the hardening of the binder.

In one feature of the invention, the homogeneous waste-binder matrix remaining in the container after the treatment discussed above may be afforded additional protection against release of pollutants to the environment by placing such container within a larger container prior to storage, and filling the space between the two containers with a suitable binding agent such as bituminous material or concrete.

BRIEF DESCRIPTION OF THE DRAWING

The invention is further set forth in the following detailed description taken in conjunction with the appended drawing, in which the single FIGURE is a representation of a waste treatment installation suitable for carrying out the process of the instant invention.

DETAILED DESCRIPTION

Referring now to the drawing, an installation 101 suitable for preparing a charge of radioactive or toxic waste for long-term storage is shown. The installation includes a lower, vertically disposed furnace A having a cylindrical wall 1 in which a suitable heating element 2 is supported. The furnace has a removable bottom cover 3, having a weight sensing element 4 which aids in determining when the proper quantity of binding agent, as discussed below, has been mixed with the waste to be stored.

A container 5, which is filled to an appropriate extent with radioactive or toxic waste to be treated, is positioned within the working space of the container A when the cover 3 is removed, after which the cover is again attached to the furnace wall 1 to form a gas-tight seal. A plurality of temperature sensors 6, 6 extend through the wall 1 of the furnace for continually monitoring the temperature of the container 5 and thereby the waste contained therein.

A condenser B is supported above and in communication with the furnace A. The condenser has a conventional heat exchange unit including a contoured length of tubing 11, such tubing being associated with horizontal guide plates 12. A gas-permeable, bell-shaped bubble tray 7 is supported in the condenser B below the heat exchanger 11, 12, such tray having a network of heating and/or cooling pipes 8 extending therethrough. Condensate collecting on the sloped side walls of the bubble tray 7 may be removed from the condenser B via a condensate drain 10. One or more viewing windows 9 are positioned around the circumference of the condenser wall, such windows communicating with conduits 102 that terminate in the interior of the bubble tray 7.

A removable top cover 13 is associated with the open upper end of the condenser B. The cover 13 has a gas inlet and outlet fitting 15. In addition, a manometer 14 is associated with the cover 3 for measuring pressure inside the condenser and the underlying furnace A.

A thermally insulated tube 16, having a closable valve 17 therein, extends centrally through the cover 16 and the interior of the condenser B for introducing, through an open upper end of the waste container 5, a hardenable binding agent such as molten bituminous material, which may be introduced into the tube 16 from a suitable source 103 when the valve 17 is opened.

The operation of the installation 101 for the preparation of several enumerated types of waste for long-term storage will now be described.

The container 5, containing waste such as radioactive ash and/or solid combustion residues, is inserted upwardly into the furnace A through the open bottom wall thereof, after which the cover 3 is attached to the furnace wall 1. The temperature of the container and its contents is thereafter raised, by suitable excitation of the heating element 2, to a value above the softening or sintering point of the binding agent to be introduced, which in the case of molten bituminous material is about 100° C.; typically, the heating element 2 is adjusted so that the temperature of the waste is about 200° C., as monitored by the temperature sensors 6. If desired, the heating of the container and its contents can be proceeded by an initial evacuation of the furnace and condenser via the gas port 15 in the top cover 13 together with an initial heating if the waste is to be dried.

After the waste in the container has reached the desired temperature, and in accordance with the invention, the furnace and condenser are then evacuated again through the port 15 to subject the waste to a partial vacuum. At this point, the valve 17 is open, and the soft binding agent 103 is introduced into the container 5 through the tube 16, whereby under the urging force of the partial vacuum the molten binding agent thoroughly impregnates and wets the particles of waste.

When a sufficient quantity of binding agent has penetrated through the waste so that the upper surface of the waste is completely covered with the binder (as viewed, e.g., through the window 9), the partial vacuum is removed by flooding the interior of the condenser and furnace with air or an inert gas through the two-way port 15. Such increase of pressure has been found to yield a particularly rapid and uniform additional impregnation of the waste with the binding agent in the container. The heating element 2 is then deenergized, whereupon the waste-binder matrix formed in the container 5 is allowed to cool and harden into a homogeneous mass without the formation of porous areas that have been found disadvantageous in the prior art.

In the event that the waste to be treated in the installation 101 is in the form of a spent ion exchange resin having embedded therein radioactive inorganic compounds, it is advantageous, prior to the addition of the binding agent thereto, to subject the resin to an initial thermal decomposition in the manner described in the above-noted copending, coassigned application. Such thermal decomposition, which is preferably accomplished in the presence of a medium which does not support combustion, is a carbonization-type procedure wherein the resin (loaded into the container 5) is heated via the heating element 2 in the depicted installation to a temperature sufficient to cause carbonization of the resin but insufficient to cause evaporation or sublimation of the radioactive compounds embedded therein.

The carbonization of the resin under such circumstances leads to the generation of gaseous products, which flow upwardly from the furnace A and through the gas-permeable bubble tray 7 to the heat-exchange portion 11, 12 of the condenser. Initially, the tubing 8 in the bubble tray 7 is heated and the tubing 11 of the heat exchanger cooled, so that the gaseous products of the carbonization are condensed. In order to remove the condensate, such heating and cooling operations are reversed whereby the heat exchanger is heated and the bubble tray is cooled, whereby the condensate is collected on the walls of the bubble tray and removed from the installation through the drain 10.

After the completion of the thermal decomposition of the resin, the above-mentioned steps of evacuating the installation 101 and introducing the binding agent into the container supporting the resin residue can be accomplished in the manner described above.

In the event that the waste is composed of coarse-grained material to be combined with a binding agent in the form of a cement-sand-water mixture, the above-described heating and cooling facilities in the installation 101 need not be employed. However, like the above applications, the desired homogeneous mixing of the hydraulic binder with the waste is assured by the application of a partial vacuum to the waste as the binder is added thereto. Moreover, a rapid and uniform mixing is enhanced under such circumstances if, before setting of the binder, the partial vacuum is removed.

The technique of the invention can also be adapted for the embedding of highly radioactive wastes, such as spent nuclear fuel and isotopes, in a suitable glass or metal binder. In such case, the binder is placed on top of the waste in the container prior to the insertion of the container into the furnace A from below. In such case, the container is heated to a temperature above the melting point of the overlying binder, and the above-mentioned partial vacuum is applied to the contents of the container in order to promote thorough impregnation of the waste by the binder. Also, to promote the homogeneity of the resulting matrix, the partial vacuum is removed by flooding the installation 101 with air or an inert gas prior to the cooling and hardening of the matrix, such cooling being effected by deenergizing the heating element 2.

The container loaded with the now-homogeneous waste-binder matrix is removed from the installation 101 via the bottom furnace port 3 to complete the hardening of the binding agent.

Advantageously, the container filled with the now-homogeneous matrix is placed, prior to final storage of the waste, within a larger container, and the space between the two containers filled with a suitable binding agent such as bituminous or concrete. The resultant structure provides enhanced protection against water penetration during the long-term storage of the waste.

In the foregoing, an illustrative technique of the invention has been described. Many variations and modifications will now occur to those skilled in the art. It is accordingly desired that the scope of the appended claims not be limited to the specific disclosure herein contained.

What is claimed is:

1. A process of preparing loose solid radioactive or toxic wastes for long-term storage, comprising placing the waste in a container, subjecting the container and its waste content to a partial vacuum, while the container and its waste content are under said partial vacuum introducing a flowable, hardenable binding agent into the container so as to thoroughly impregnate the waste, and thereafter hardening the binding agent.

2. A method as defined in claim 1, further comprising the step of removing the partial vacuum after the adding step and prior to the hardening step.

3. A method as defined in claim 1, further comprising the step, prior to the adding step, of thermally decomposing the waste in the presence of a medium that does not support combustion.

4. A method as defined in claim 1, further comprising the step, prior to the adding step, of simultaneously subjecting the waste to heat and a partial vacuum to dry the waste.

5. A method as defined in claim 1, further comprising the step, during the adding step, of maintaining the waste at a temperature at least equal to the softening temperature of the binder.

6. In a method of preparing solid radioactive or toxic waste for long-term storage, the steps of placing the waste in a first container; applying a partial vacuum to the container; adding a first hardenable binder to the partially evacuated first container while the first container is heated to a temperature at least equal to the softening temperature of the first binder; removing the partial vacuum from the first container; hardening the first binder to form a waste-binder matrix; placing the first container with the waste-binder matrix within and in spaced relation to the wall of a larger second container; and filling the space between the first and second containers with a second binder.

7. A method as defined in claim 6, in which the second binder is a material selected from the group consisting of bitumen and concrete.

8. A method as defined in claim 1, in which the waste consists of radioactive ashes.

9. A method as defined in claim 1, in which the waste is composed of coarse-grained material.

10. A method as defined in claim 1, in which the hardenable binding agent is bituminous material.

* * * * *

UNITED STATES PATENT OFFICE

CERTIFICATE OF CORRECTION

Patent No. 4,139,488 Dated February 13, 1979

Inventor(s) Karl KNOTIK, Peter LEICHTER, Heinz JAKUSCH

It is certified that error appears in the above-identified patent and that said Letters Patent are hereby corrected as shown below:

Change the name of the assignee, appearing on the front page of the above-identified patent from "Vereinigte Edelstahlwerke Aktiengesellschaft, Vienna, Austria"

to

--Vereinigte Edelstahlwerke Aktiengesellschaft (VEW),

Signed and Sealed this

*Thirty-first* Day of *July 1979*

[SEAL]

*Attest:*

*Attesting Officer*

LUTRELLE F. PARKER

*Acting Commissioner of Patents and Trademarks*

UNITED STATES PATENT AND TRADEMARK OFFICE

CERTIFICATE OF CORRECTION

PATENT NO. : 4,139,488

DATED : February 13, 1979

INVENTOR(S) : Karl KNOTIK, Peter LEICHTER, Heinz JAKUSCH

It is certified that error appears in the above-identified patent and that said Letters Patent are hereby corrected as shown below:

Change the name of the assignee, appearing on the front page of the above-identified patent from "Vereinigte Edelstahlwerke Aktiengesellschaft, Vienna, Austria"

to

--Vereinigte Edelstahlwerke Aktiengesellschaft (VEW), Vienna, Austria, and Oesterreichische Studiengesellschaft fuer Atomenergie GmbH., Vienna, Austria, a part interest each --.

Signed and Sealed this

*Seventeenth* Day of *June 1980*

[SEAL]

*Attest:*

SIDNEY A. DIAMOND

*Attesting Officer*

*Commissioner of Patents and Trademarks*